US011519570B2

(12) United States Patent
Wu et al.

(10) Patent No.: US 11,519,570 B2
(45) Date of Patent: Dec. 6, 2022

(54) LAMP AND LAMP ASSEMBLY

(71) Applicant: OPPLE LIGHTING CO., LTD., Shanghai (CN)

(72) Inventors: Shihui Wu, Shanghai (CN); Zhanguo Liu, Shanghai (CN); Kai Wang, Shanghai (CN); Chuan Liang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/113,389

(22) Filed: Dec. 7, 2020

(65) Prior Publication Data

US 2021/0088191 A1 Mar. 25, 2021

Related U.S. Application Data

(63) Continuation of application No. PCT/CN2019/090576, filed on Jun. 10, 2019.

(30) Foreign Application Priority Data

Jun. 7, 2018 (CN) ..... 201810582244.3
Jun. 7, 2018 (CN) ..... 201820878327.2
Jun. 20, 2018 (CN) ..... 201820950438.X

(51) Int. Cl.
*F21S 2/00* (2016.01)
*F21V 29/70* (2015.01)
(Continued)

(52) U.S. Cl.
CPC ..... *F21S 2/005* (2013.01); *F21V 11/00* (2013.01); *F21V 17/10* (2013.01); *F21V 21/26* (2013.01); *F21V 29/70* (2015.01); *F21Y 2105/16* (2016.08)

(58) Field of Classification Search
CPC ..... F21V 17/04; F21V 29/70; F21V 11/00; F21V 17/10; F21V 21/26; F21Y 2105/16
See application file for complete search history.

(56) References Cited

U.S. PATENT DOCUMENTS 10,690,332 B1 * 6/2020 Wu ..... H05K 5/0217
2008/0089071 A1 * 4/2008 Wang ..... F21V 29/763 362/294

(Continued)

FOREIGN PATENT DOCUMENTS

CN 101539278 A * 9/2009 ..... F21V 21/005
CN 201363568 Y 12/2009

(Continued)

OTHER PUBLICATIONS

International Search Report of PCT Application No. PCT/CN2019/090576 dated Sep. 12, 2019 with English translation, (6p).

*Primary Examiner* — Anabel Ton
(74) *Attorney, Agent, or Firm* — Arch & Lake LLP

(57) ABSTRACT

The disclosure discloses a lamp and a lamp assembly. The lamp has a splicing structure and a connecting side, the splicing structure is arranged on the connecting side, the splicing structure includes a first clamping groove and a second clamping groove extending in a same direction, and a notch of the first clamping groove and a notch of the second clamping groove face in opposite directions. Two lamps can be spliced through a lamp connecting module to form a lamp assembly. The lamp connecting module includes a first lamp connector and a second lamp connector, each first lamp connector can be clamped with two first clamping grooves of the two lamps at the same time, each second lamp connector can be clamped with two second clamping grooves of the two lamps at the same time, and the first lamp connector is detachably fixed with the second lamp connector.

17 Claims, 15 Drawing Sheets

(51) Int. Cl.

| | |
|---|---|
| ***F21V 11/00*** | (2015.01) |
| ***F21V 17/10*** | (2006.01) |
| ***F21V 21/26*** | (2006.01) |
| *F21Y 105/16* | (2016.01) |

(56) References Cited

U.S. PATENT DOCUMENTS

| | | | | |
|---|---|---|---|---|
| 2011/0002120 | A1* | 1/2011 | Song | F21V 29/89 362/249.02 |
| 2013/0148340 | A1* | 6/2013 | Shen | F21V 21/14 362/184 |
| 2013/0208471 | A1 | 8/2013 | Lueken et al. | |
| 2017/0292664 | A1* | 10/2017 | Pearson | F21V 29/70 |
| 2018/0080637 | A1* | 3/2018 | Didone' | F21V 3/02 |
| 2020/0072454 | A1* | 3/2020 | Li | F21V 29/763 |

FOREIGN PATENT DOCUMENTS

| | | | | | |
|---|---|---|---|---|---|
| CN | 201582685 | U | * | 9/2010 | F21S 8/086 |
| CN | 104832807 | A | | 8/2015 | |
| CN | 205938672 | A | | 2/2017 | |
| CN | 206280814 | U | | 6/2017 | |
| CN | 108518620 | A | | 9/2018 | |
| CN | 208170161 | U | | 11/2018 | |
| CN | 208222265 | U | | 12/2018 | |
| JP | 2017073261 | A | | 4/2017 | |
| KR | 20130028235 | A | * | 3/2013 | |

* cited by examiner

LAMP AND LAMP ASSEMBLY

CROSS-REFERENCE TO RELATED APPLICATIONS

This application is based upon and claims the priority of PCT patent application No. PCT/CN2019/090576 filed on Jun. 10, 2019 which claims priority to the Chinese patent application No. 201810582244.3 filed on Jun. 7, 2018 and the Chinese patent application No. 201820878327.2 filed on Jun. 7, 2018 and the Chinese patent application No. 201820950438.X filed on Jun. 20, 2018, the entire content of all of which is hereby incorporated by reference herein for all purposes.

TECHNICAL FIELD

The present disclosure relates to the technical field of lighting, in particular to a lamp and a lamp assembly.

BACKGROUND

With the development of modern society, the lighting technology is constantly improving. All kinds of lamps are used in people's production and life to provide convenience for people. In order to expand the lighting range, many lamps are often spliced together in application.

SUMMARY

The present disclosure provides a lamp and a lamp assembly.

The present disclosure provides a lamp. The lamp may include a splicing structure and a connecting side, where the splicing structure may be arranged on the connecting side, the splicing structure may include a first clamping groove and a second clamping groove extending in a same direction, and a notch of the first clamping groove and a notch of the second clamping groove may face in opposite directions.

The present disclosure provides a lamp assembly. The lamp assembly may include two lamps, and a set of lamp connecting module. Each of the two lamps may include a splicing structure and a connecting side, where the splicing structure is arranged on the connecting side, the splicing structure comprises a first clamping groove and a second clamping groove extending in a same direction, and a notch of the first clamping groove and a notch of the second clamping groove face in opposite directions.

The lamp connecting module may include a first lamp connector and a second lamp connector, each first lamp connector is capable of being clamped with two first clamping grooves of the two lamps at the same time, each second lamp connector is capable of being clamped with two second clamping grooves of the two lamps at the same time, and the first lamp connector is detachably fixed with the second lamp connector.

The present disclosure further provides a lighting lamp. The lighting lamp may include a lighting module, an angle adjusting mechanism and a bracket, where the angle adjusting mechanism may be slidably arranged in a groove on a side of the lighting module, the bracket may be connected to the angle adjusting mechanism, and the angle adjusting mechanism may slide to a position to be installed and may be fixed on the lighting module.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples of the present disclosure and their descriptions are used to explain the present disclosure, and do not constitute the limitation of the present disclosure. In the drawings.

DETAILED DESCRIPTION

Figure 1:
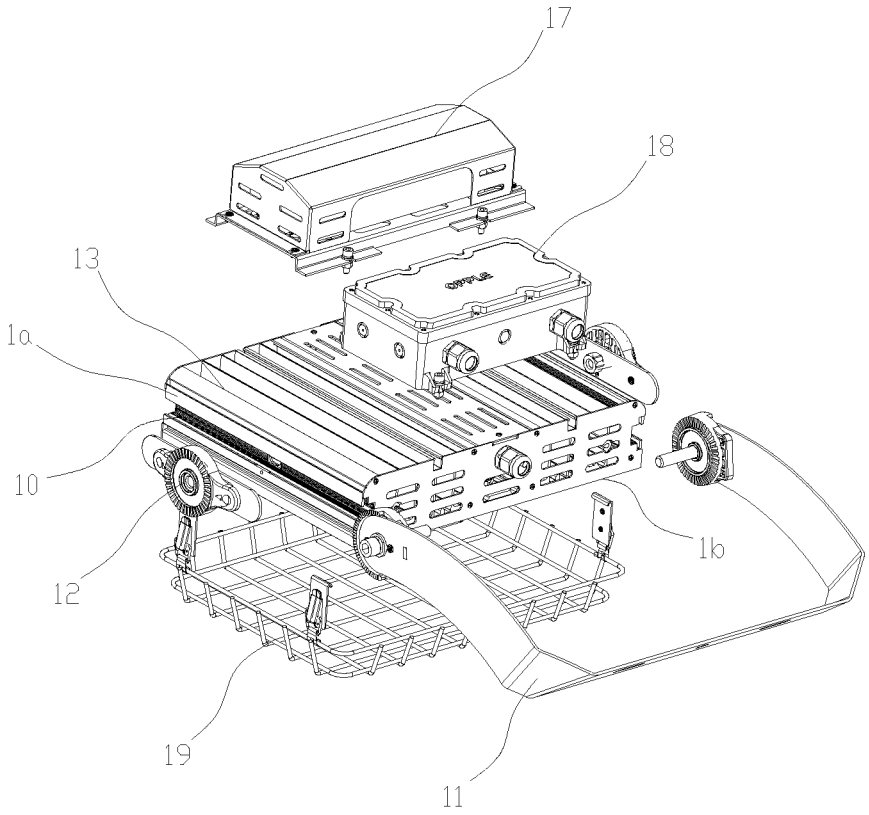
FIG. 1 is an exploded view of a lamp according to an example of the present disclosure.

In order to make objects, technical details and advantages of the present disclosure apparent, the technical solutions of the present disclosure will be described in a clearly and fully understandable way in connection with examples of the present disclosure and corresponding drawings. The described examples are just a part but not all of the examples of the present disclosure. Based on the examples of the present disclosure, those skilled in the art can obtain other example(s), without any inventive work, which should be within the scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numbers used in this disclosure may include:

1—lamp; 1*a*—connecting side; 1*b*—light exit side; 10—splicing structure; 10*a*—first clamping groove; 10*a*1—first insertion opening; 10*b*—second clamping groove; 10*b*1—second insertion opening; 10*c*—third clamping groove; 10*c*1—third insertion opening; 10*d*—avoidance groove; 11—bracket; 111—connecting arm; 1111—connecting portion; 12—bracket connecting module; 121—first bracket connector; 122—second bracket connector; 123—first screw component; 124—second screw component; 13—heat sink; 131—light source mounting portion; 132—convex rib; 1321—first rib; 1322—second rib; 14—light source module; 141—optical element; 142—light source; 143—light source substrate; 15—mask; 16—sealing ring; 17—power supply module; 18—waterproof junction box; 19—protective net; 2—lamp connecting module; 21—first lamp connector; 211—first fixing portion; 212—first clamping portion; 213—third clamping portion; 22—second lamp connector; 221—second fixing portion; 222—second clamping portion; 23—third screw component; 3—connecting portion;

1—lighting lamp; 10—lighting module; 11—angle adjusting mechanism; 12—bracket; 101—concave groove; 111—mounting plate; 112—first toothed base; 113—second toothed base; 114—first fixing member; 115—second fixing member; 116—third fixing member; 1161—locking screw; 1162—nut; 1163—gasket; 1111—fixing hole; 1121—first through hole; 1131—second through hole; 121—fixing hole; 1112—mounting and positioning portion; 1122—first positioning portion; 122—bracket positioning portion; 1132—second positioning portion; 102—lamp body.

In some implementations of lamps, the splicing method is to directly open threaded holes on the lamps to be spliced, and then fix the lamps with threaded holes on the same connecting plate by screws, so as to realize the splicing of multiple lamps.

However, in this splicing method, it is necessary to open a threaded hole on each lamp, and the connecting plate needs to be aligned with the threaded hole on each lamp and screwed one by one in the splicing process, so the operation during splicing is very cumbersome.

The present disclosure provides a lamp 1, referring to FIGS. 1 to 10, the lamp 1 has a connecting side 1*a* and a splicing structure 10. The splicing structure 10 is arranged on the connecting side 1*a*, and the splicing structure 10 includes a first clamping groove 10*a* and a second clamping groove 10*b* extending in the same direction. The notch of the first clamping groove 10*a* and the notch of the second clamping groove 10*b* face in opposite directions.

Figure 5:
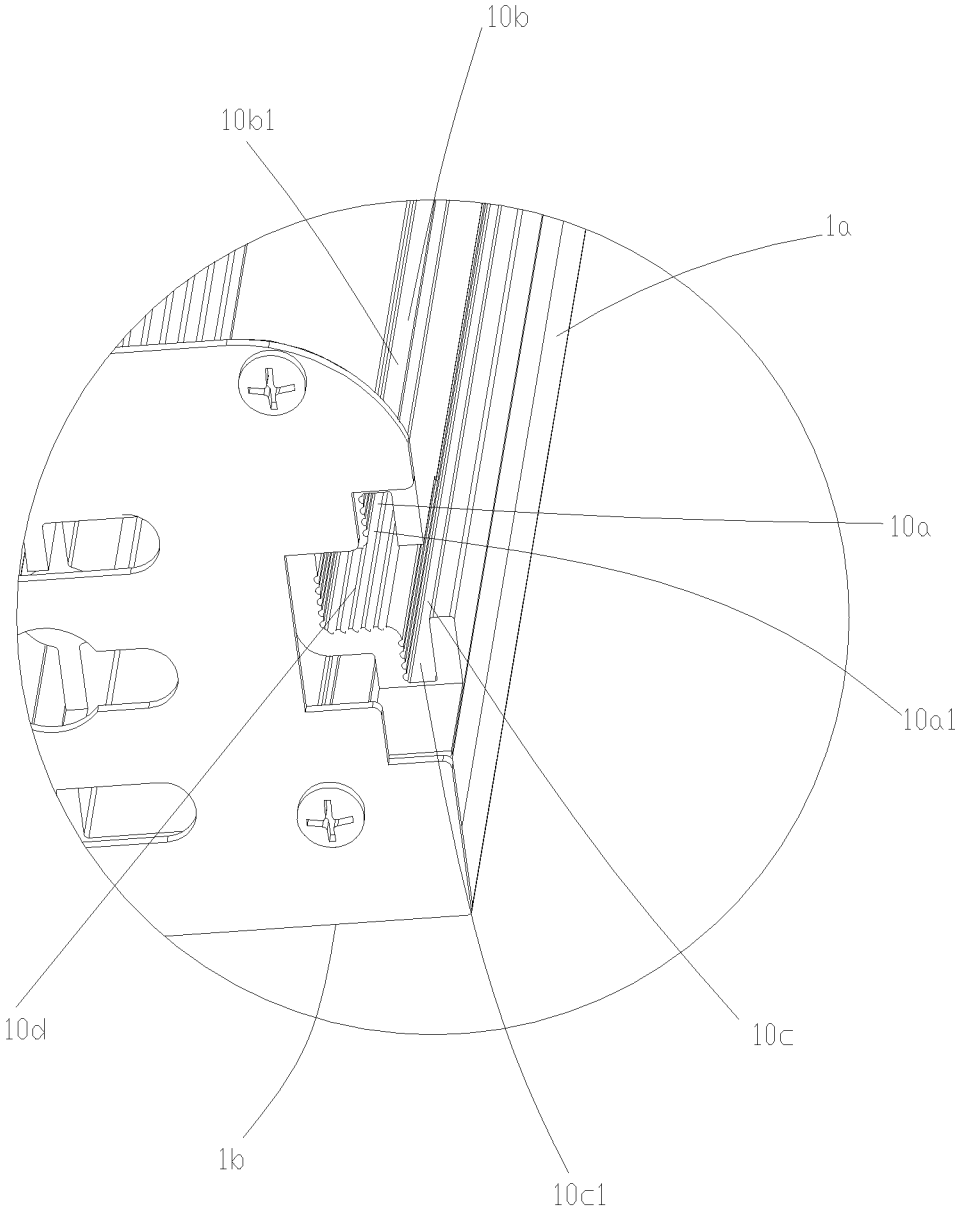
FIG. 5 is a partial enlarged view of part A in FIG. 4.

When being spliced, the lamp 1 in this example needs to adopt a lamp connecting module 2. Referring to FIG. 5, the lamp connecting module 2 includes a first lamp connector 21 and a second lamp connector 22. Each first lamp connector 21 is capable of being clamped with two first clamping grooves 10*a* of two lamps 1 at the same time, and each second lamp connector 22 is capable of being clamped with two second clamping grooves 10*b* of two lamps 1 at the same time. At the same time, the first lamp connector 21 and the second lamp connector 22 can be detachably fixed. Because this splicing method does not need to be aligned with the screw holes on each lamp, the splicing process is greatly simplified.

The first lamp connector 21 includes a first fixing portion 211 and two first clamping portions 212. The two first clamping portions 212 are both connected to the first fixing portion 211. The second lamp connector 22 includes a second fixing portion 221 and two second clamping portions 222, the two second clamping portions 222 are both connected to the second fixing portion 221.

Figure 8:
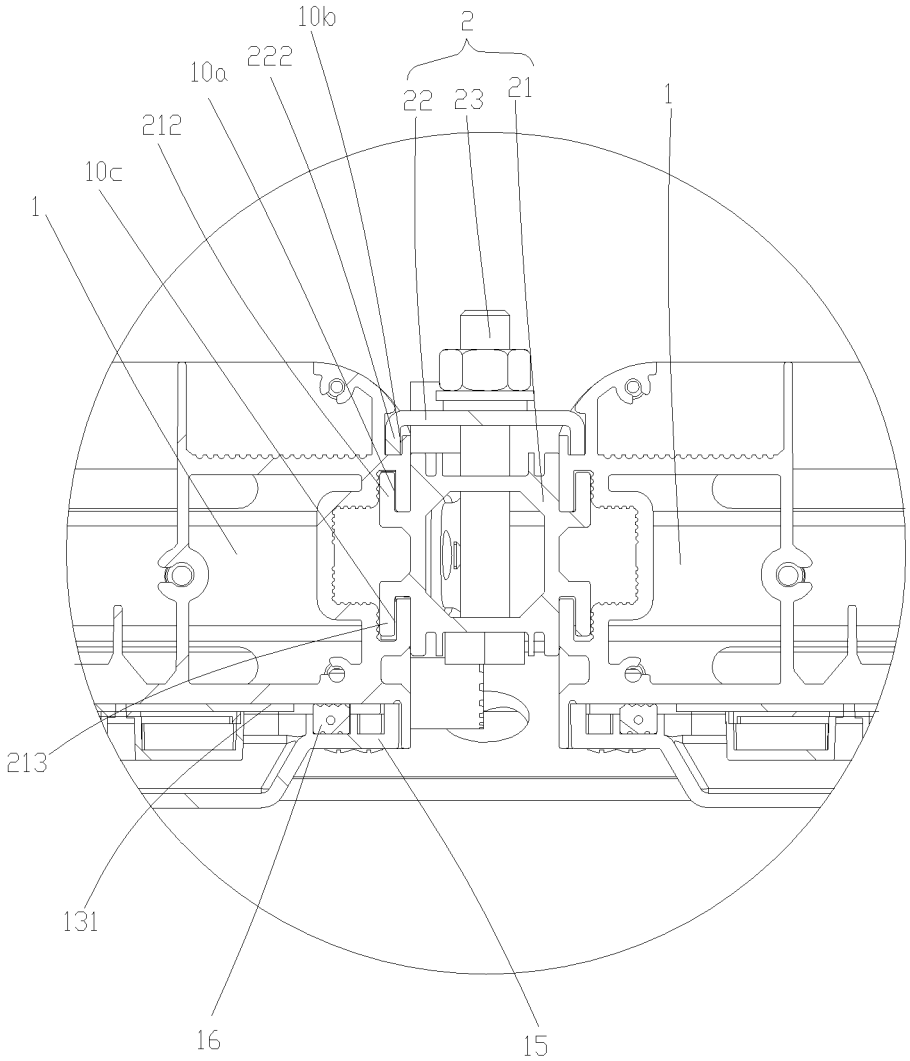
FIG. 8 is a partial enlarged view of part B in FIG. 5.

Referring to FIG. 8, each first clamping portion 212 can be respectively clamped with the first clamping groove 10*a* of one lamp 1, so that the first lamp connector 21 can be clamped with two lamps 1 at the same time. Each second clamping portion 222 can be respectively clamped with the second clamping groove 10*b* of one lamp 1, so that the second lamp connector 22 can be clamped with two lamps 1 at the same time. The first fixing portion 211 and the second fixing portion 221 are detachably fixed.

The lamp 1 also has a light exit side 1*b*, and when the light exit side 1*b* is a front side, the connecting side 1*a* can be set to be perpendicular to the light exit side 1*b*.

Both of the first clamping groove 10*a* and the second clamping groove 10*b* can be perpendicular to the direction in which the connecting side 1*a* faces, so that the first clamping groove 10*a* and the second clamping groove 10*b* are easier to be processed and shaped.

At least one end of the first clamping groove 10*a* can extend to an edge of the connecting side 1*a*, so that the first clamping groove 10*a* can form a first insertion opening 10*a*1 from the edge of the connecting side 1*a*. The first clamping portion 212 can be inserted into the first clamping groove 10*a* from the first insertion opening 10*a*1, which is convenient for the first lamp connector 21 to be connected to the lamp 1. Similarly, at least one end of the second lamp connector 22 can also extend to an edge of the connecting side 1*a*, so that the second clamping groove 10*b* can form an insertion opening from the edge of the connecting side 1*a*. As illustrated in FIG. 5, when the notch of the second clamping groove 10*b* directly communicates with the outside, the notch of the second clamping groove 10*b* can be used as a second insertion opening 10*b*1, and the second clamping portion 222 can be inserted into the second clamping groove 10*b* from the second insertion opening 10*b*1, so that the second lamp connector 22 is connected to the lamp 1. The first lamp connector 21 can slide in the first clamping groove 10*a* after being connected to the lamp 1 through the first insertion opening 10*a*1, and the second lamp connector 22 can slide in the second clamping groove 10*b* after being connected to the lamp 1 through the second insertion opening 10*b*1, so that the first lamp connector 21 and the second lamp connector 22 can be conveniently detachably connected at ideal positions.

In the present disclosure, two lamps 1 can be spliced by one lamp connecting module 2 or a plurality of (two or more) lamp connecting modules 2, and the number of the lamp connecting modules 2 can be set according to actual conditions.

In the present disclosure, the connecting mode of the first lamp connector 21 and the second lamp connector 22 is not limited. In some examples, they can be connected by a third screw component 23 (including a screw and a nut). At this time, the first lamp connector 21 and the second lamp connector 22 are both formed with corresponding through holes. Specifically, the first fixing portion 211 and the second fixing portion 221 both can be plate-shaped and formed with corresponding through holes. The first clamping portion 212 can be formed through bending by 90 degrees at both sides of the first fixing portion 211, and the second clamping portion 222 can be formed through bending by 90 degrees at both sides of the second fixing portion 221. In the process of splicing two lamps 1, the first lamp connector 21 slides along the first clamping groove 10*a* through the first clamping portion 212, and/or the second lamp connector 22 slides along the second clamping groove 10*b* through the second clamping portion 222, so as to align the through holes in the first fixing portion 211 and the second fixing portion 221, and then connect the first fixing portion 211 with the second fixing portion 221 through the matching of screws and nuts, thus splicing the two lamps 1.

Figure 4:
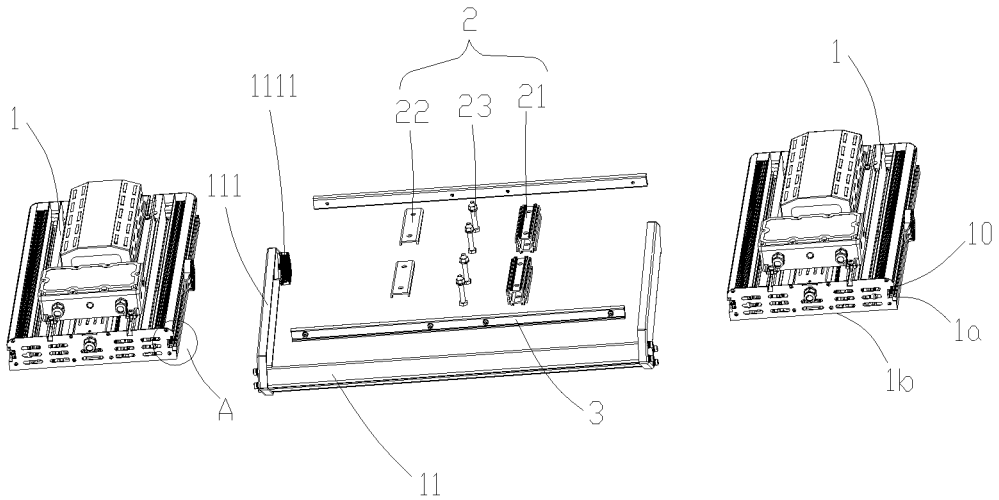
FIG. 4 is an exploded view of the lamp illustrated in FIG. 3.

Referring to FIG. 4, when a plurality of lamps 1 of the lamp assembly of the present disclosure are connected by the lamp connecting module 2, in order to enhance the splicing firmness, a plurality of connecting plates 3 can be provided. The connecting plates 3 are connected to the plurality of lamps 1 at the same time, and the connecting plates 3 and the lamp connecting module 2 are respectively connected to the adjacent sides of the lamps 1.

Further referring to FIGS. 5 to 8, when the first lamp connector 21 and the second lamp connector 22 are connected, in order to improve the fixation of the two lamps 1, the splicing structure 10 can also have a third clamping groove 10*c* extending in a direction the same as that of the first clamping groove 10*a*, the third clamping groove 10*c* is located on a side of the first clamping groove 10*a* away from the second clamping groove 10*b*, and the notch of the third clamping groove 10*c* faces the notch of the first clamping groove 10*a*. Similar to the first clamping groove 10*a* described above, at least one end of the third clamping groove 10*c* can also extend to an edge of the lamp 1, so that the third clamping groove 10*c* can form a third insertion opening 10*c*1 from the edge of the lamp 1.

In order to make the positioning process of the lamp connecting module 2 simpler, in the splicing process of the lamps 1, one end of the first clamping groove 10*a* and one end of the third clamping groove 10*c* both extend to a same edge of the connecting side 1*a*, and the first insertion opening 10*a*1 and the third insertion opening 10*c*1 are formed at the edge, respectively. The first lamp connector 21 further includes a third clamping portion 213, and the first clamping portion 212 and the third clamping portion 213 are simultaneously mounted to the first clamping groove 10*a* and the third clamping groove 10*c* through the first insertion opening 10*a*1 and the third insertion opening 10*c*1, so that the first lamp connector 21 is slidably connected to the first clamping groove 10*a* and the third clamping groove 10*c* at the same time. Of course, the present disclosure is not limited to this, and a third lamp connector with a third clamping portion 213 can also be provided.

In order to facilitate adjusting the position of the light exit side 1*b*, the lamp 1 can include a bracket 11. The bracket 11 can be used for one lamp 1 individually. When a plurality of lamps 1 are spliced into a lamp assembly, the plurality of lamps 1 in the lamp assembly can share one bracket 11 for support, or each lamp 1 can be equipped with one bracket 11. The bracket 11 can be placed on a working surface. In order to enable the bracket 11 to be placed at an appropriate position of the lamp 1 according to requirements, so that the lamp 1 has an appropriate distance from the working surface, the position of the bracket 11 on the lamp 1 can be adjusted in the present disclosure.

Figure 7:
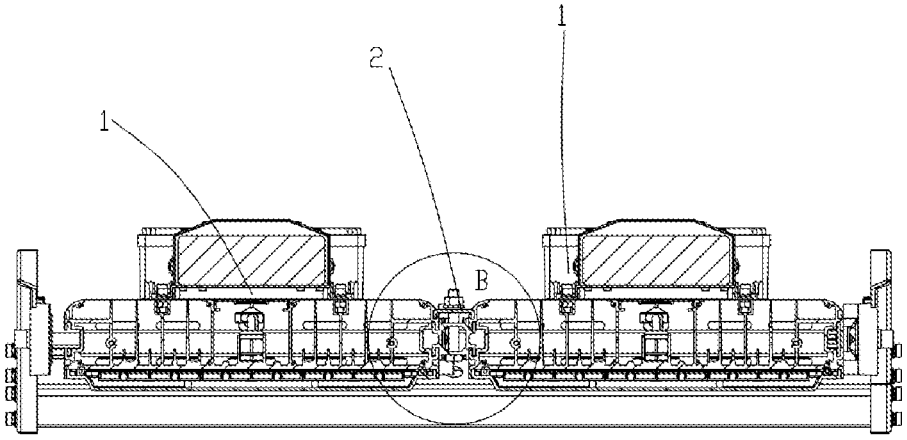
FIG. 7 is an exploded view of the lamp assembly illustrated in FIG. 3 along a direction A-A'.

In order to facilitate mounting the bracket 11, referring to FIGS. 1, 7 and 8, the lamp 1 further includes a bracket connecting module 12. The bracket connecting module 12 is spliced with the splicing structure 10 and connected to the bracket 11 at the same time. Because this connecting mode will occupy a splicing structure 10, if the lamp 1 is still capable of being spliced and combined with other lamps 1 at this time, it is necessary that the lamp 1 has two connecting sides 1*a* facing away from each other, and each connecting side 1*a* is provided with a splicing structure 10. In this way, one of the splicing structures 10 is used to connect the bracket connecting module 12, and the other splicing structure 10 can continue to match with the lamp connecting module 2 to be spliced with other lamps 1 (refer to FIGS. 4 and 9). It should be noted that when a single lamp 1 is used independently and does not need to be spliced with other lamps 1, in order to improve the stability of the bracket 11, two bracket connecting modules 12 can be set at the same time to be connected to two splicing structures 10, and then the bracket 11 can be connected to the two bracket connecting modules 12 at the same time (refer to FIG. 1).

The bracket connecting module 12 can be slidably connected to the first clamping groove 10*a* and the third clamping groove 10*c* at the same time, and the bracket connecting module 12 is connected to the bracket 11, so that the bracket 11 can be arranged at a desired position according to requirements.

The bracket connecting module 12 includes a first bracket connector 121 and a second bracket connector 122 connected to each other. At the same time, one end of the first clamping groove 10*a* and one end of the third clamping groove 10*c* respectively extend to a same edge of the lamp 1 and form a first insertion opening 10*a*1 and a third insertion opening 10*c*1 at the edge. The first bracket connector 121 can simultaneously slide into the first clamping groove 10*a* and the third clamping groove 10*c* through the first insertion opening 10*a*1 and the third insertion opening 10*c*1 and slide along the first clamping groove 10*a* and the third clamping groove 10*c*, and the second bracket connector 122 is located outside the first clamping groove 10*a* and the third clamping groove 10*c* and connected to the first bracket connector 121.

Figure 9:
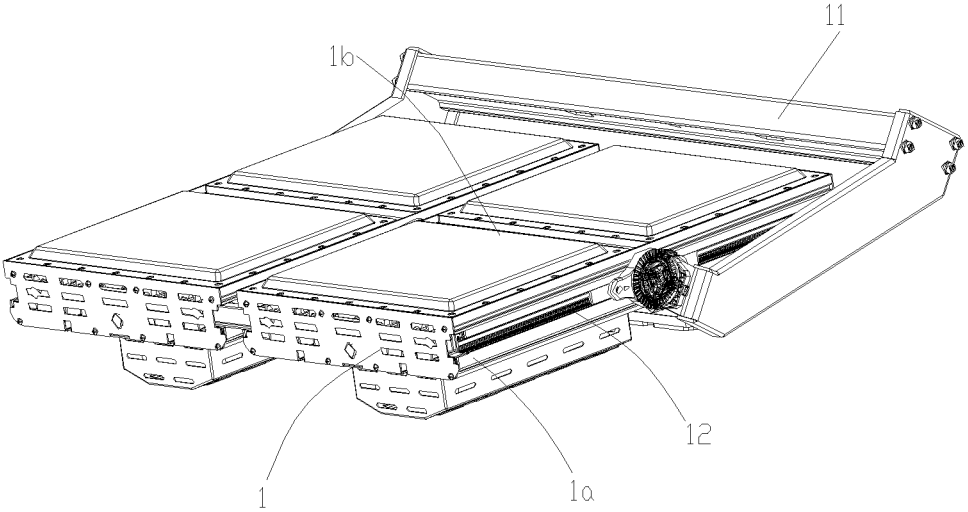
FIG. 9 is a perspective view of a lamp assembly having two lamps and each lamp having two light source modules according to another example of the present disclosure.

Referring to FIGS. 4, 5 and 9 at the same time, the bracket 11 has a connecting arm 111, and the connecting arm 111 has a connecting portion 1111. When the bracket 11 is assembled, the connecting portion 1111 is connected to the bracket connecting module 12. The first bracket connector 121 and the second bracket connector 122 can be connected by screws, etc. When the connecting position of the bracket 11 on the lamp 1 needs to be adjusted, the connecting screws of the first bracket connector 121 and the second bracket connector 122 can be loosened, then the bracket connecting module 12 can slide to the required position, and finally the connecting screws of the first bracket connector 121 and the second bracket connector 122 can be tightened.

Referring to FIG. 4, the connecting portion 1111 of the bracket 11 can be pivotally connected to the bracket connecting module 12 through a rotating shaft, so that the angle between the bracket 11 and the bracket connecting module 12 can be adjusted according to requirements. At the same time, in order that the bracket 11 and the bracket connecting module 12 can be fixed to each other without rotating after the angle of the bracket 11 is adjusted, the connecting portion 1111 of the bracket 11 and the second bracket connector 122 of the bracket connecting module 12 can be set as a group of crown gear components which are matched with each other.

The splicing structure 10 further has an avoidance groove 10*d*, the avoidance groove 10*d* is located between the first clamping groove 10*a* and the third clamping groove 10*c*. And the notch of the avoidance groove 10*d* faces in a direction the same as the direction in which the connecting side 1*a* faces. The bracket connecting module 12 further includes a first screw component 123. The first screw component 123 penetrates through the bracket 11, the second bracket connector 122 and the first bracket connector 121, so that the bracket 11 and the first screw component 123 are rotatably connected, and then the bracket 11 and the bracket connecting module 12 are rotatably connected, and the rotating shaft is perpendicular to the connecting side. The first screw component 123 has a first screw head, the first screw head extends into the avoidance groove 10*d*. Of course, the first screw head of the first screw component 123 can also be located at the side of the bracket 11, and the bracket connecting module 12 further includes a first nut, the first nut extends into the avoidance groove 10*d*.

In addition, the bracket connecting module 12 can further include a second screw component 124, the first bracket connector 121 and the second bracket connector 122 are connected to each other through the second screw component 124, and the second screw component 124 can have a second screw head which extends into the avoidance groove 10*d*. Of course, the second screw head can also be located at the side of the second bracket connector 122, and the second screw component 124 includes a second nut which extends into the avoidance groove 10*d*.

Figure 2:
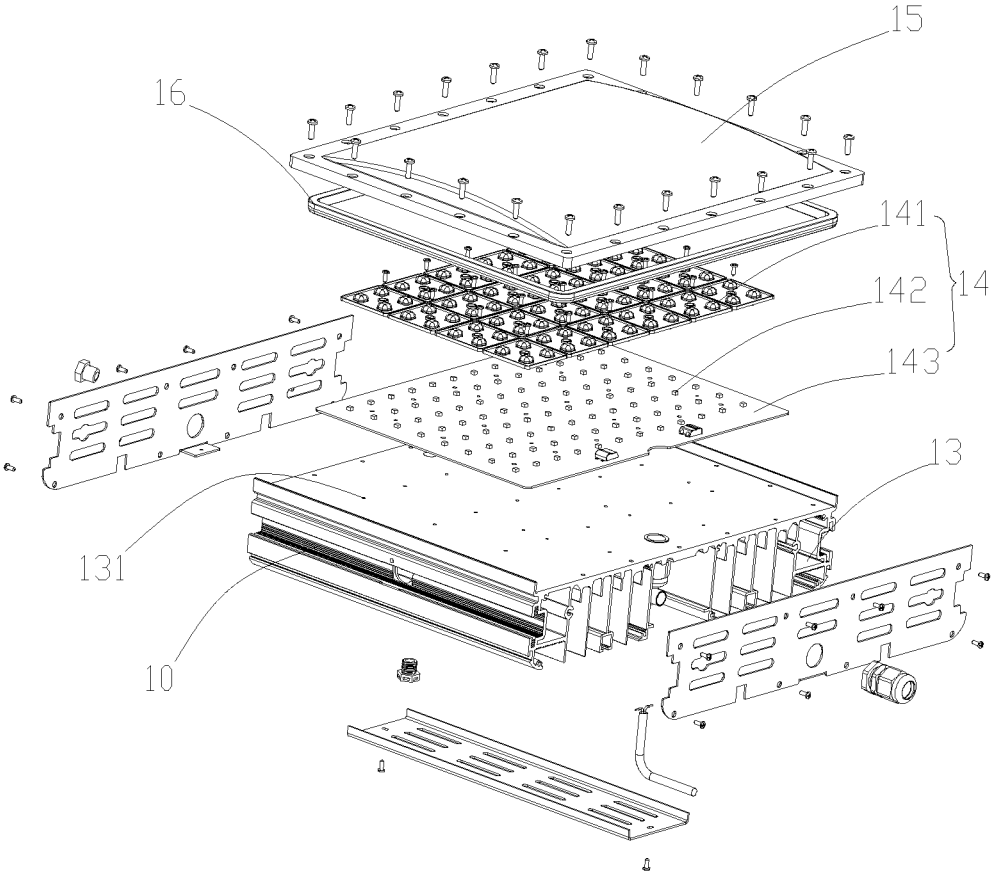
FIG. 2 is an exploded view of a light source module and a heat sink of the lamp illustrated in FIG. 1.
Figure 3:
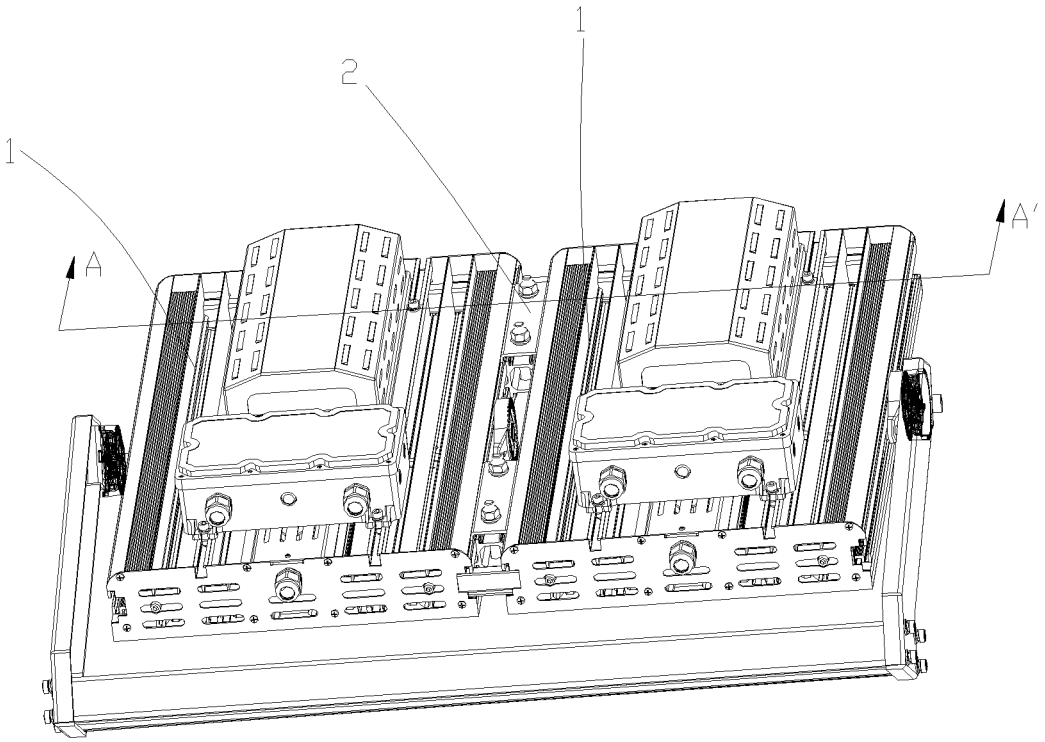
FIG. 3 is a perspective view of a lamp assembly with two lamps according to an example of the present disclosure.
Figure 10:
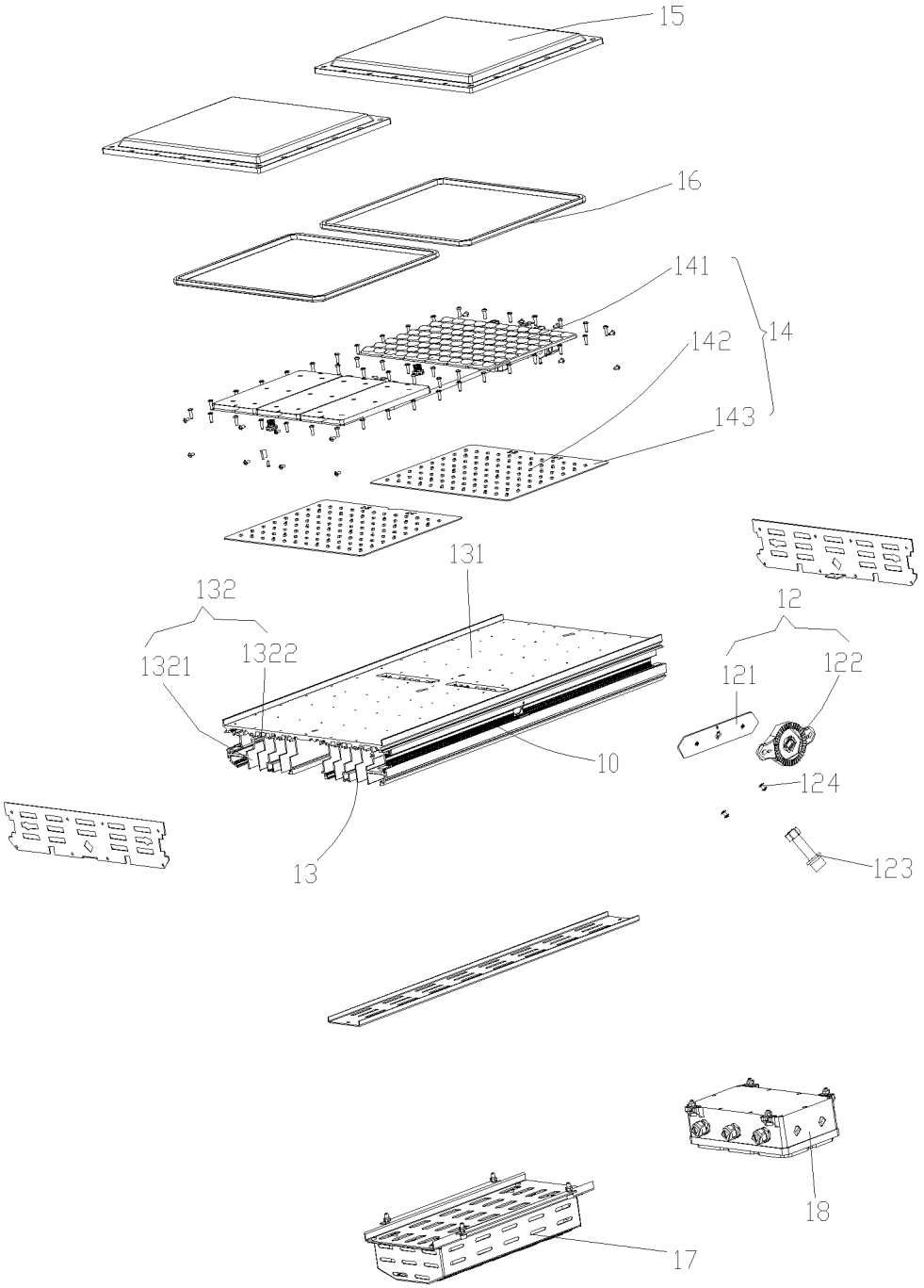
FIG. 10 is an exploded view of the lamp illustrated in FIG. 9.
Figure 11:
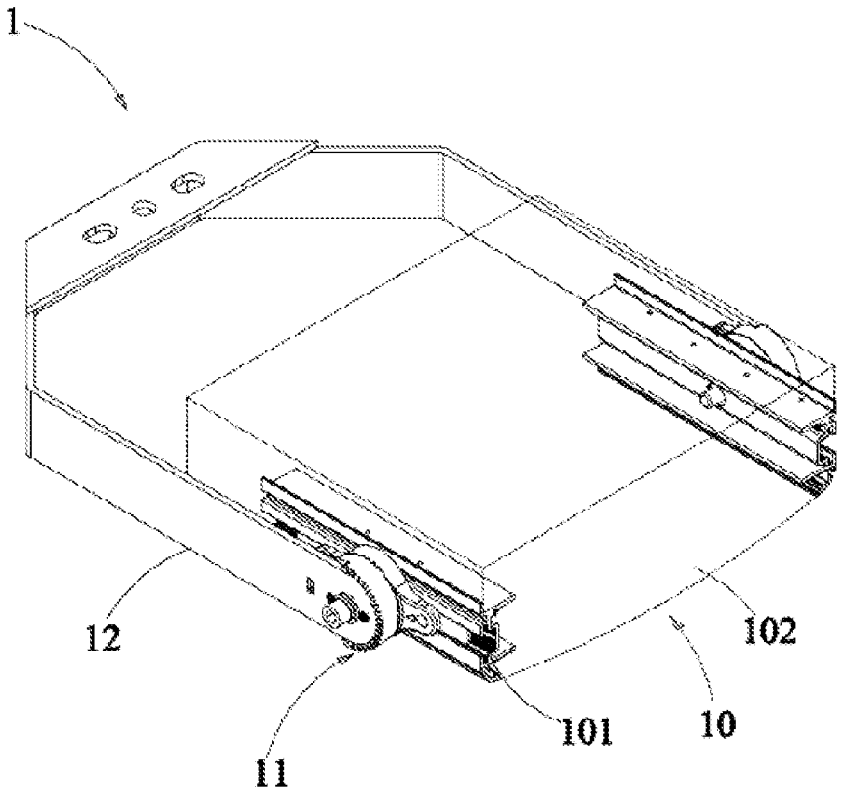
FIG. 11 is a perspective view of a lighting lamp according to a first example of the present disclosure.
Figure 12:
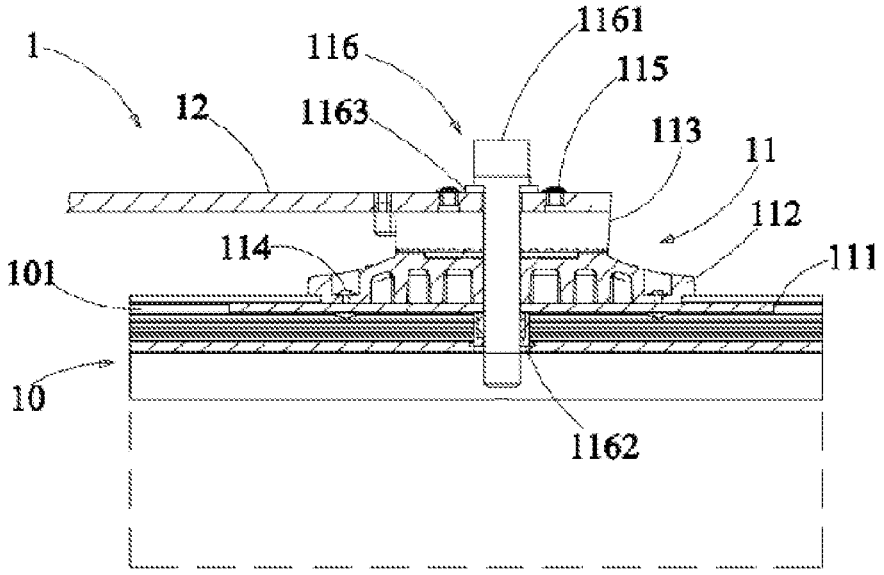
FIG. 12 is a sectional view of a lighting lamp according to the first example of the present disclosure.
Figure 13:
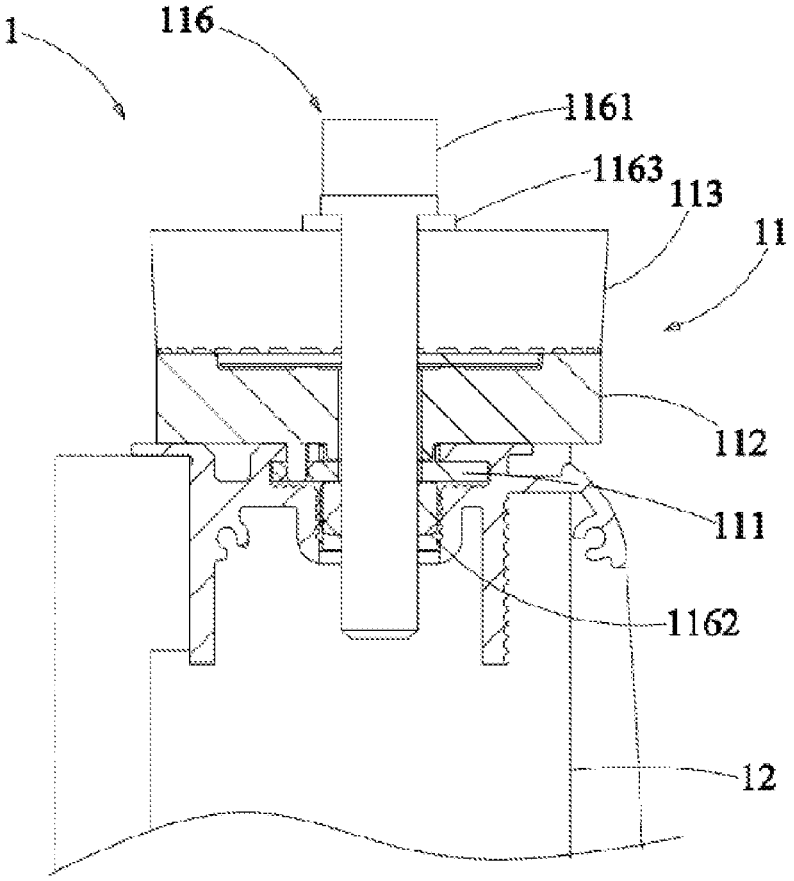
FIG. 13 is another sectional view of a lighting lamp according to the first example of the present disclosure.
Figure 14:
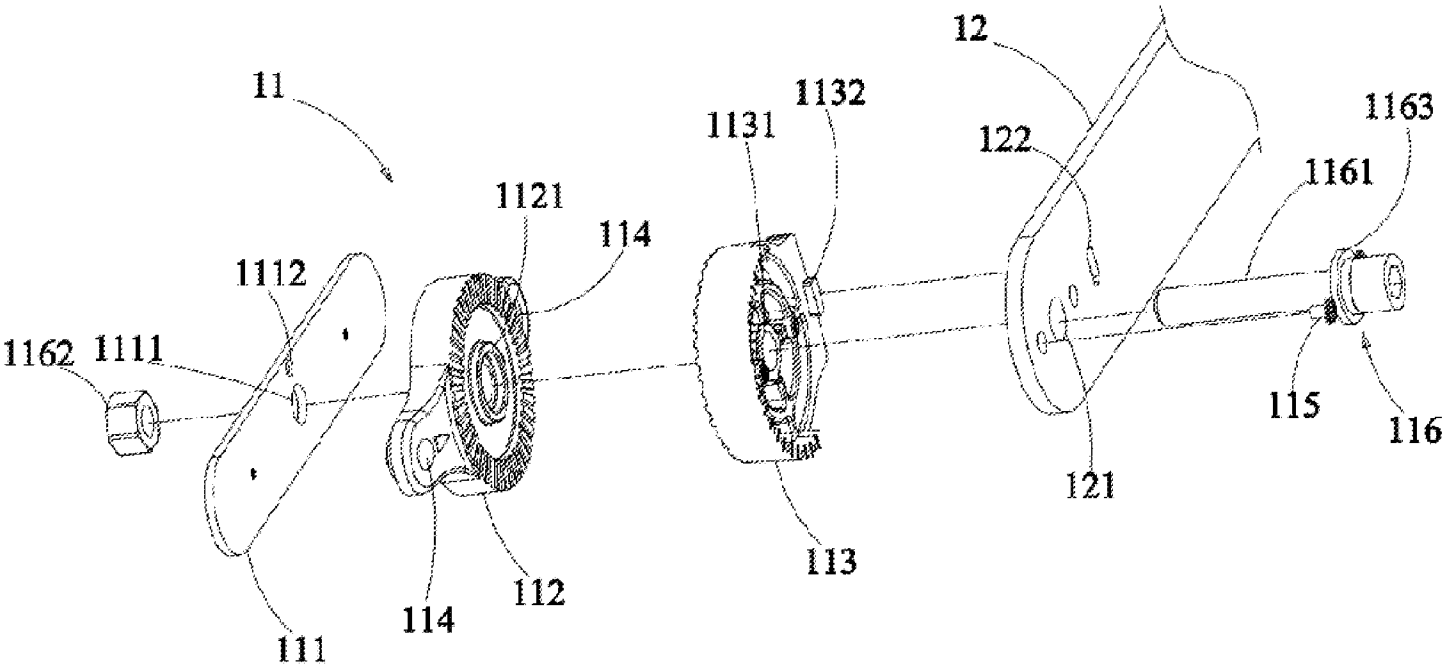
FIG. 14 is an assembly view of an angle adjusting mechanism and a bracket according to the first example of the present disclosure.
Figure 15:
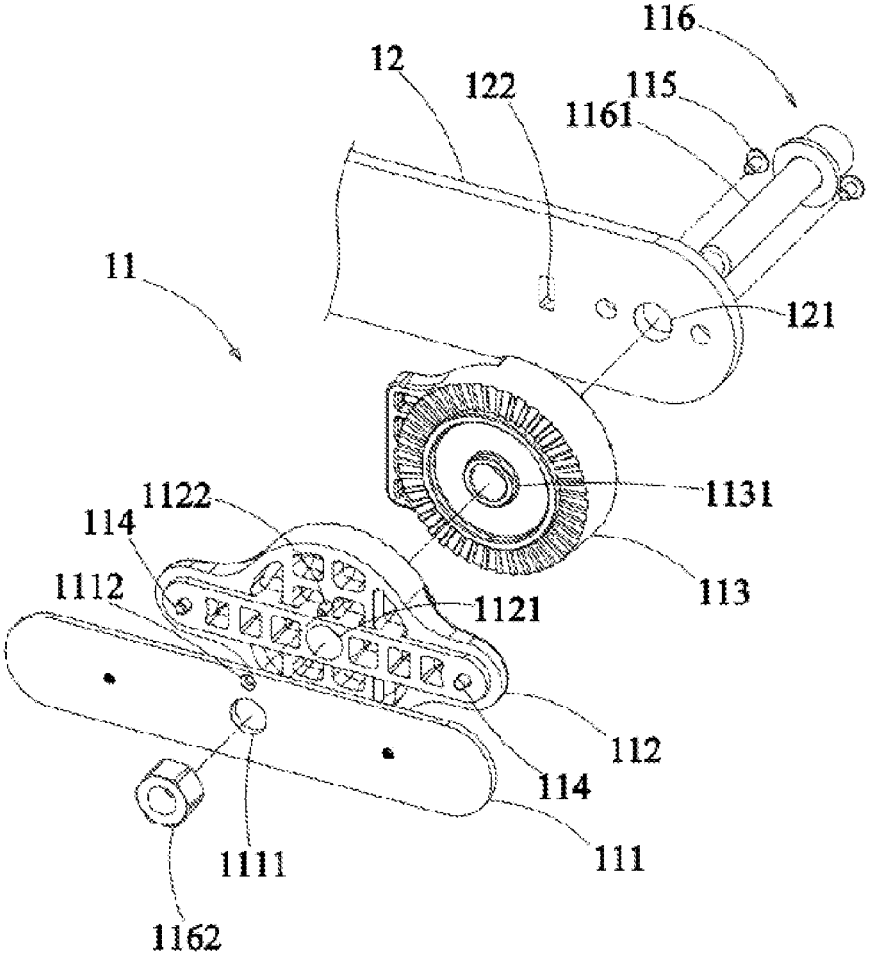
FIG. 15 is another assembly view of an angle adjusting mechanism and a bracket according to the first example of the present disclosure.

In order to improve the stability of splicing, the direction in which the connecting side 1*a* faces can be perpendicular to that of the light exit side 1*b* of the lamp 1. Referring to FIGS. 1, 2 and 10, in an example, the lamp 1 can include a heat sink 13, a light source module 14 and a mask 15, and can further include a sealing ring 16 for sealing. One lamp 1 can include one light source module 14 (see FIGS. 1 to 4), or can include a plurality of light source modules 14 (for example, two, see FIGS. 9 and 10). For convenient arrangement, the first clamping groove 10*a* and the second clamping groove 10*b* can be arranged on the heat sink 13. The light source module 14 is arranged on the heat sink 13. The light source module 14 includes an optical element 141, a light source 142 and a light source substrate 143. The heat sink 13 has a light source mounting portion 131, the light source substrate 143 of the light source module 14 is mounted on the light source mounting portion 131, the light source 142 is mounted on a side of the light source substrate 143 away from the heat sink 13, and the optical element 141 covers the light source 142 and the light source substrate 143. The mask 15 entirely covers the light source module 14. The sealing ring 16 is located at the connecting position between the mask 15 and the light source mounting portion 131, and is used to protect the part between the mask 15 and the light source mounting portion 131, i.e., to protect the light source 142, the light source substrate 143 and other components placed in this part.

Figure 6:
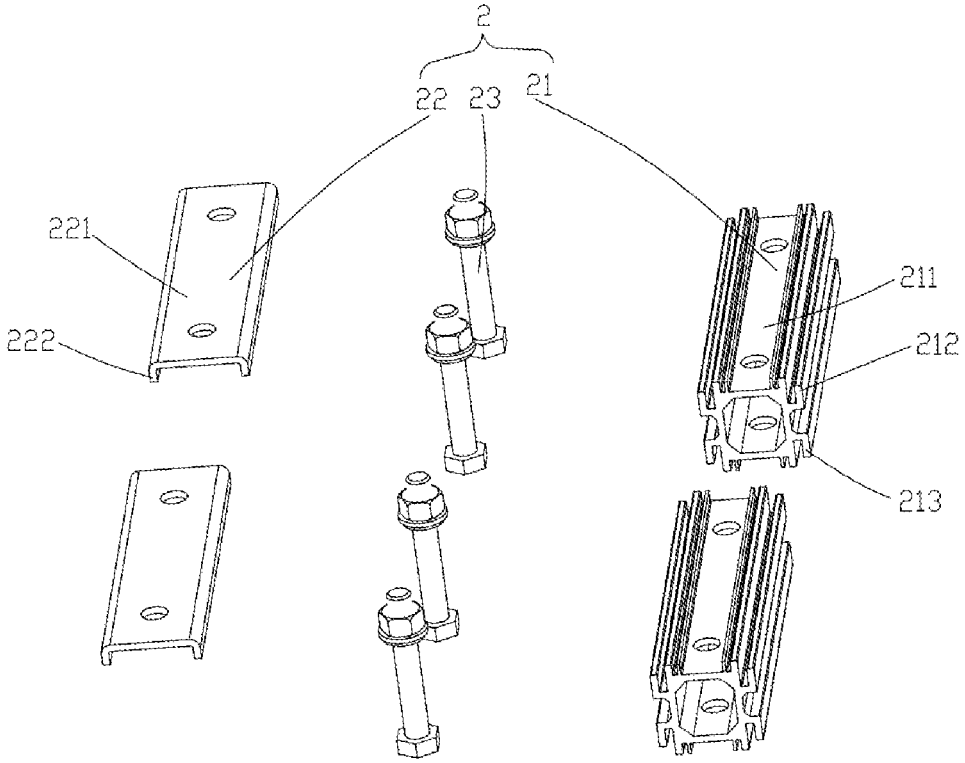
FIG. 6 is an exploded enlarged view of a lamp connecting module of the lamp assembly illustrated in FIG. 3.

Referring to FIG. 6, because the light source module 14 generates heat when working, the sealing ring 16 is deformed due to the elevated temperature, which affects its service life. In order to minimize the influence of high temperature on the service life of the sealing ring 16, it is preferable to set the inside of the sealing ring 16 to be hollow, so that the sealing ring 16 can have a certain deformation space, thereby improving its service life. At the same time, in order to improve the sealing and waterproof performance of the sealing ring 16, a radial section of one side of the sealing ring 16 attached to the heat sink 13 can be set to have a wavy shape, so that the contact area between the sealing ring 16 and the light source mounting portion 131 is reduced, thereby increasing the pressure between the sealing ring 16 and the light source mounting portion 131 and enhancing the sealing effect.

Referring to FIG. 8, in order to improve the heat dissipation performance, the heat sink 13 can further be provided with a plurality of convex ribs 132, the convex rib 132 is perpendicular to the light source mounting portion 131. And the convex ribs 132 and the light source module 14 are respectively located on two opposite sides of the light source mounting portion 131. The convex ribs 132 include a first rib 1321 and a second rib 1322 spaced apart from each other. The lengths of the first rib 1321 and the second rib 1322 along the direction perpendicular to the light source mounting portion 131 are different, so that one end of the heat sink 13 with high heat and close to the light source module 14 has more convex ribs 132, while the other end with low heat and away from the light source module 14 has fewer convex ribs 132, so that the heat sink 13 can perform good air convection with the outside air through the first rib 1321 and the second rib 1322, and so that the heat sink 13 dissipates heat evenly.

In addition, the lamp 1 according to the examples of the present disclosure can further include a power supply module 17 for providing a driving signal for the light source module 14 and a waterproof junction box 18 for waterproof. The power supply module 17 and the waterproof junction box 18 can be arranged on the heat sink 13 and located on the side of the heat sink 13 opposite to the light source module 14. In the present disclosure, when one lamp 1 includes a plurality of light source modules 14, the plurality of light source modules 14 can share one power supply module 17, or each light source module 14 can be driven by one power supply module 17, or several light source modules 14 can share one power supply module 17, which is not limited by the present disclosure. In order to prevent foreign objects from hitting the light source module 14, a protective net 19 can be provided outside the light source module 14 for protection (refer to FIG. 1).

At present, the floodlight available in the market is a point light source that can illuminate uniformly in all directions. The floodlight produces highly diffuse and directionless light instead of a well-defined beam, which is widely used in large lighting places such as airports, large docks, squares and stadiums. However, the traditional floodlights have the following problems: the adjustment of light irradiation angle is not flexible enough, the range is small, and there are certain limitations, and the mounting structure is complex and difficult when a plurality of sets of floodlights are arranged and assembled; an integrated light source is used generally, the heat at the light source is very concentrated and is not easy to be dissipated immediately, which is very unfavorable for heat dissipation; when the illumination angle is adjusted by the reflective cup cooperated with the integrated light source, it leads to a single illumination angle of the light source. At present, the floodlight adjusts its illumination angle through an angle adjusting device, but the position of the angle adjusting device on the floodlight cannot be adjusted, resulting in that the bracket connected to the angle adjusting device cannot be adjusted, and the installation of the floodlight is easily limited by the installation position.

Please refer to FIG. 11, FIG. 12, FIG. 13, FIG. 14, and FIG. 15, which are a perspective view and a sectional view of a lighting lamp, and assembly views of an angle adjusting mechanism and a bracket according to a first example of the present disclosure. As illustrated in the figures, the lighting lamp 1 of this example includes a lighting module 10, an angle adjusting mechanism 11 and a bracket 12. The number of the angle adjusting mechanisms 11 is two, which are slidably arranged in concave grooves 101 on two sides of the lighting module 10. The angle adjusting mechanism 11 can slide relative to the lighting module 10 to adjust its position, and is fixed to the lighting module 10 after the angle adjusting mechanism 11 is adjusted to the position to be installed. After setting the angle adjusting mechanism 11, two ends of the bracket 12 are respectively connected to the angle adjusting mechanisms 11 arranged on two sides of the lighting module 10, respectively. The angle adjusting mechanism 11 of this example includes a mounting plate 111, a first toothed base 112 and a second toothed base 113. The mounting plate 111 is inserted into a concave groove 101 on a side of the lighting module 10, slides to a position to be mounted, and is fixed on the lighting module 10 by a first fixing member 114, the first fixing member 114 is a screw which locks the mounting plate 111 to a side wall of the concave groove 101. The first toothed base 112 is arranged on the mounting plate 111, and the second toothed base 113 is arranged on the first toothed base 112. The tooth portion of the first toothed base 112 is engaged with the tooth portion of the second toothed base 113. The first toothed base 112 and the second toothed base 113 in this example are crown gears. Two ends of the bracket 12 are respectively connected to second toothed bases 113 of the angle adjusting mechanisms 11, the two ends of the bracket 12 are respectively fixed to the second toothed bases 113 by a second fixing member 115, and the second fixing member 115 is a screw.

Two ends of the bracket 12 are respectively fixed to the mounting plate 111 by a third fixing member 116. The third fixing member 116 in this example includes a locking screw 1161 and a nut 1162. The nut 1162 is arranged between the mounting plate 111 and the concave groove 101 of the lighting module 10 and corresponds to the fixing hole 1111 of the mounting plate 111. The first toothed base 112 has a first through hole 1121 corresponding to the fixing hole 1111, the second toothed base 113 has a second through hole 1131 corresponding to the first through hole 1121, and two ends of the bracket 12 respectively have fixing holes 121 corresponding to the second through hole 1131. The locking screw 1161 penetrates through the fixing hole 121 on two ends of the bracket 12, the second through hole 1131 of the second toothed base 113, the first through hole 1121 and the fixing hole 1111, and is locked to the nut 1162, so as to fix the first toothed base 112 and the second toothed base 113 to the mounting plate 111, and to fix the bracket 12 to the angle adjusting mechanism 11 at the same time. There is a gasket 1163 between the locking screw 1161 and the bracket 12. The mounting plate 111 of this example has a mounting positioning portion 1112, and the first toothed base 112 has a first positioning portion 1122 corresponding to the mounting positioning portion 1112. When the first toothed base 112 is arranged on the mounting plate 111, the mounting positioning portion 1112 and the first positioning portion 1122 are aligned and assembled to position the first toothed base 112 on the mounting plate 111. Similarly, the bracket 12 has a bracket positioning portion 122, and the second toothed base 113 has a second positioning portion 1132 corresponding to the bracket positioning portion 122. When the second toothed base 113 is arranged on the bracket 12, the bracket positioning portion 122 and the second positioning portion 1132 are aligned and assembled to position the second toothed base 113 on the bracket 12. In this example, the mounting positioning portion 1112 and the bracket positioning portion 122 are holes, and the first positioning portion 1122 and the second positioning portion 1132 are protrusions corresponding to the holes.

The lighting lamp 1 of this example is fixed to an object through the bracket 12. When the locking screw 1161 is locked to the nut 1162, the tooth portion of the second toothed base 113 is engaged with the tooth portion of the first toothed base 112, so the bracket 12 cannot drive the second toothed base 113 to rotate relative to the first toothed base 112. When adjusting the angle of the bracket 12 relative to the lighting module 10, the locking screw 1161 is loosened to separate the second toothed base 113 from the first toothed base 112 firstly, and the bracket 12 drives the second toothed base 113 to rotate relative to the first toothed base 112 to adjust the angle of the bracket 12 relative to the lighting module 10. When adjusting the position of the bracket 12 relative to the lighting module 10, the first fixing member 114 is removed firstly, and the mounting plate 111 is moved in the concave groove 101 to the position to be installed, so as to drive the first toothed base 112, the second toothed base 113 and the bracket 12 to move relative to the lighting module 10. When the bracket 12 moves to the position to be installed, the mounting plate 111 is fixed to the lighting module 10 through the first fixing member 114, so as to fix the bracket 12 to the lighting module 10. The lighting module 10 of this example only has a single lamp body 102.

Figure 16:
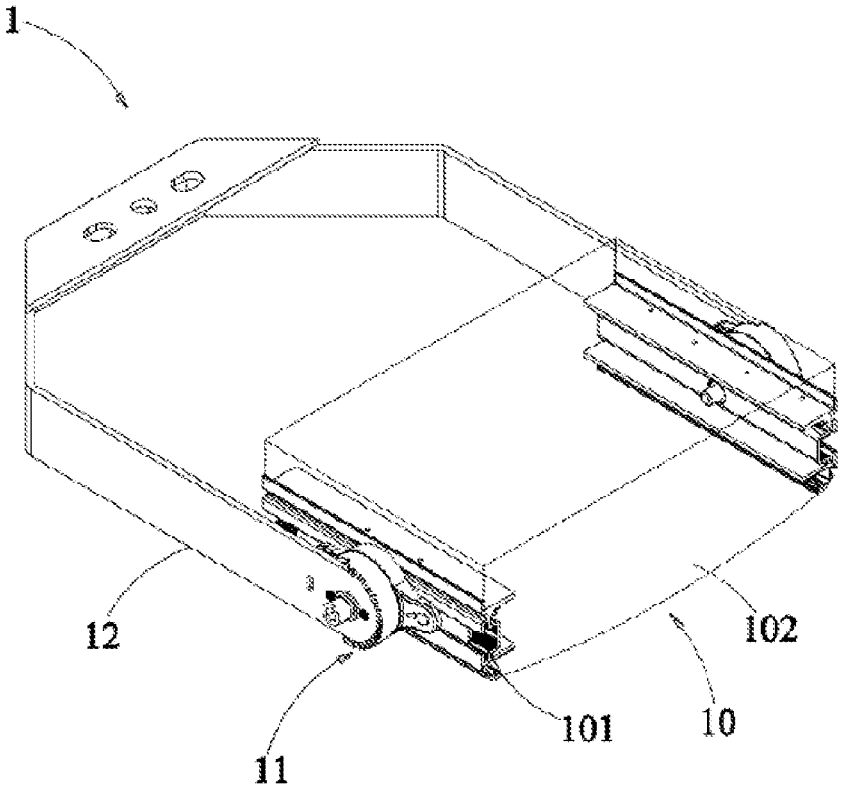
FIG. 16 is a perspective view of a lighting lamp according to a second example of the present disclosure.
Figure 17:
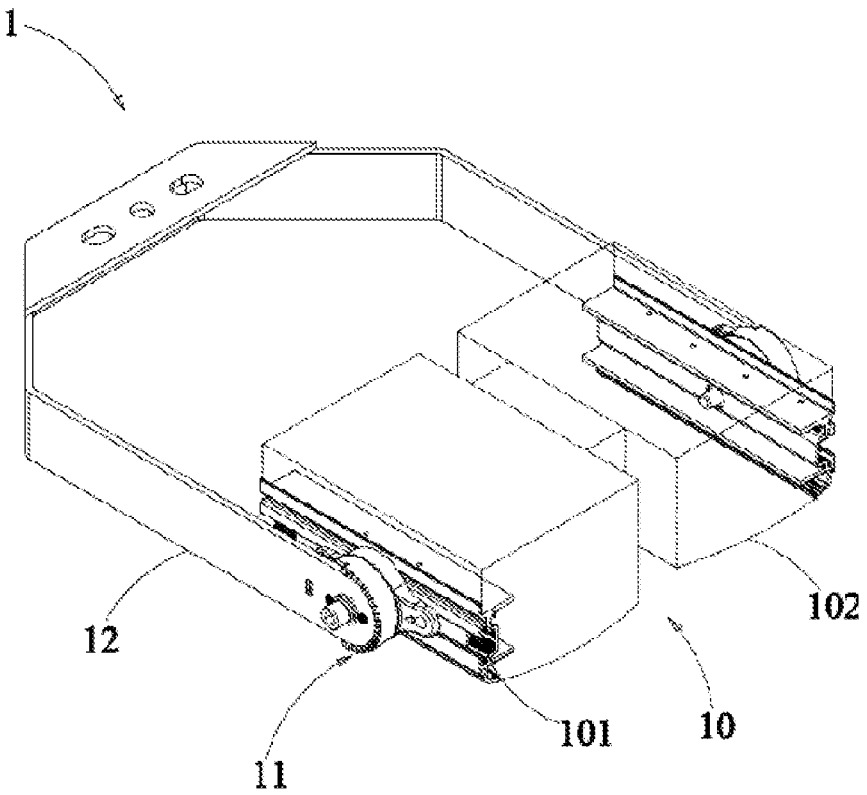
FIG. 17 is a perspective view of a lighting lamp according to a third example of the present disclosure.

Please refer to FIG. 16, which is a perspective view of a lighting lamp according to a second example of the present disclosure. As illustrated in the figure, the lighting module 10 of this example also only has a single lamp body 102. The length of the lamp body 102 of this example is shorter than that of the lamp body of the first example, which means that the size of the lamp body 102 can be different. Please refer to FIG. 17, which is a perspective view of a lighting lamp according to a third example of the present disclosure. As illustrated in the figure, the lighting module 10 of this example is made by splicing two lamp bodies 102, which also means that the lighting module 10 can be made by splicing a plurality of lamp bodies 102. It can be seen from the above examples that the angle adjusting mechanism 11 of the present disclosure can be applied to lamp bodies 102 with various sizes, or to a lighting module 10 formed by splicing a plurality of lamp bodies 102, and the size of the bracket 12 is selected according to the size of the lighting module 10, and is assembled to the angle adjusting mechanism 11.

To sum up, the present disclosure provides a lighting lamp. The angle adjustment mechanism of the lighting lamp can slide on the lighting module and drive the bracket to move relative to the lighting module, so as to adjust the position of the bracket on the lighting module, so that the lighting lamp can adjust the position of the bracket according to objects arranged on it. The angle adjusting mechanism can be prevented from rotating due to too large weight through the engaging of two crown gears.

The present disclosure provides a lamp and a lamp assembly.

A lamp comprises a splicing structure and a connecting side, wherein the splicing structure is arranged on the connecting side, the splicing structure comprises a first clamping groove and a second clamping groove extending in a same direction, and a notch of the first clamping groove and a notch of the second clamping groove face in opposite directions.

In one example, each of the first clamping groove and the second clamping groove faces in a direction perpendicular to a direction in which the connecting side faces.

In one example, the splicing structure further has a third clamping groove extending in a direction the same as that of the first clamping groove, the third clamping groove is located at a side of the first clamping groove away from the second clamping groove, and a notch of the third clamping groove faces the notch of the first clamping groove.

In one example, the lamp has two splicing structures and two connecting sides facing away from each other, and each of the two connecting sides is provided with one of the two splicing structures; one end of the first clamping groove and one end of the third clamping groove extend to a same edge of the lamp and form a first insertion opening and a third insertion opening at the edge, respectively; the lamp further comprises a bracket and a bracket connecting module, the bracket connecting module is in sliding connection with the first clamping groove and the third clamping groove of one of the two splicing structures and the bracket connecting module is connected to the bracket.

In one example, the bracket connecting module comprises a first bracket connector and a second bracket connector, the first bracket connector is capable of simultaneously sliding into the first clamping groove and the third clamping groove through the first insertion opening and the third insertion opening and sliding along the first clamping groove and the third clamping groove, and the second bracket connector is located outside the first clamping groove and the third clamping groove and connected to the first bracket connector.

In one example, the bracket is rotatably connected to the bracket connecting module, and a rotating shaft is perpendicular to the connecting side.

In one example, the splicing structure further has an avoidance groove, the avoidance groove is located between the first clamping groove and the third clamping groove, and a notch of the avoidance groove faces in a direction the same as the direction in which the connecting side faces, the bracket connecting module further comprises a first screw component which penetrates through the bracket, the second bracket connector and the first bracket connector, and the bracket is rotatably connected to the first screw component, and the first screw component has a first screw head which extends into the avoidance groove.

In one example, the splicing structure further has an avoidance groove, the avoidance groove is located between the first clamping groove and the third clamping groove, and a notch of the avoidance groove faces a direction the same as the direction in which the connecting side faces, the bracket connecting module further comprises a second screw component, the first bracket connector and the second bracket connector are connected to each other through the second screw component, and the second screw component has a second screw head which extends into the avoidance groove.

In one example, at least one end of the first clamping groove and/or at least one end of the second clamping groove extends to an edge of the connecting side.

In one example, the lamp further has a light exit side, and the connecting side is perpendicular to the light exit side.

In one example, the lamp comprises a heat sink, and the connecting side is on the heat sink.

In one example, the lamp further comprises a light source module, a mask and a sealing ring, the light source module is arranged on the heat sink, the mask covers the light source module, and the sealing ring is located at a connecting position between the mask and the heat sink.

In one example, the sealing ring is hollow.

In one example, a radial section of one side of the sealing ring attached to the heat sink has a wavy shape.

In one example, the lamp further comprises a light source module arranged on the heat sink, the heat sink comprises a light source mounting portion and a plurality of convex ribs protruding from the light source mounting portion, and the plurality of convex ribs and the light source module are respectively on two opposite sides of the light source mounting portion.

A lamp assembly comprises two lamps as mentioned above and a set of lamp connecting module, wherein the lamp connecting module comprises a first lamp connector and a second lamp connector, each first lamp connector is capable of being clamped with two first clamping grooves of the two lamps at the same time, each second lamp connector is capable of being clamped with two second clamping grooves of the two lamps at the same time, and the first lamp connector is detachably fixed with the second lamp connector.

In one example, the lamp assembly further comprises a third screw component which passes through the first lamp connector and the second lamp connector to splice the two lamps.

In one example, the first lamp connector comprises a first fixing portion and two first clamping portions, the two first clamping portions are both connected to the first fixing portion, and the second lamp connector comprises a second fixing portion and two second clamping portions, the two second clamping portions are both connected to the second fixing portion; each first clamping portion is capable of being clamped with the first clamping groove on one lamp so that the first lamp connector are clamped with two lamps at the same time, and each second clamping portion is capable of being clamped with the second clamping groove on one lamp so that the second lamp connector are clamped with two lamps at the same time; the first fixing portion and the second fixing portion are provided with corresponding through holes, and the first fixing portion and the second fixing portion are detachably connected by matching the third screw component with the through holes.

The present disclosure further provides a lighting lamp, comprising a lighting module, an angle adjusting mechanism and a bracket, wherein the angle adjusting mechanism is slidably arranged in a groove on a side of the lighting module, the bracket is connected to the angle adjusting mechanism, and the angle adjusting mechanism slides to a position to be installed and is fixed on the lighting module.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

It should be noted that in this context, the terms "comprise," "comprising," "including," "including" or any other variant thereof are intended to cover non-exclusive inclusion, so that a process, method, article or device including a series of elements includes not only those elements, but also other elements not explicitly listed, or elements inherent to such a process, method, article or device. Without further restrictions, the element defined by the sentence "including one . . . " does not exclude the existence of other identical elements in the process, method, article or device including the element.

The above examples illustrate the objects, technical solutions and advantages of the present disclosure in further detail. It should be understood that the above are only examples of the present disclosure and are not used to limit the present disclosure. Any modification, equivalent substitution and improvement made within the spirit and principle of the present disclosure should be included in the protection scope of the present disclosure.

The invention claimed is:

1. A lamp, comprising a splicing structure and a connecting side, wherein the splicing structure is arranged on the connecting side, the splicing structure comprises a first clamping groove, a second clamping groove and a third clamping groove extending in a same direction, and a notch of the first clamping groove and a notch of the second clamping groove face in opposite directions, wherein the splicing structure is capable of implementing splicing by clamping the first clamping groove and the second clamping groove with a lamp connecting module, wherein the lamp comprises a heat sink, the connecting side is on the heat sink, and the first clamping groove and the second clamping groove are on the heat sink, and wherein the third clamping groove is located at a side of the first clamping groove away from the second clamping groove, and a notch of the third clamping groove faces the notch of the first clamping groove.

2. The lamp according to claim 1, wherein each of the first clamping groove and the second clamping groove faces in a direction perpendicular to a direction in which the connecting side faces.

3. The lamp according to claim 1, wherein:

the lamp has two splicing structures and two connecting sides facing away from each other, and each of the two connecting sides is provided with one of the two splicing structures;

one end of the first clamping groove and one end of the third clamping groove extend to a same edge of the lamp and form a first insertion opening and a third insertion opening at the edge; and the lamp further comprises a bracket and a bracket connecting module, the bracket connecting module is in sliding connection with the first clamping groove and the third clamping groove of one of the two splicing structures and the bracket connecting module is connected to the bracket.

4. The lamp according to claim 3, wherein the bracket connecting module comprises a first bracket connector and a second bracket connector, the first bracket connector is capable of simultaneously sliding into the first clamping groove and the third clamping groove through the first insertion opening and the third insertion opening and sliding along the first clamping groove and the third clamping groove, and the second bracket connector is located outside the first clamping groove and the third clamping groove and is connected to the first bracket connector.

5. The lamp according to claim 4, wherein the bracket is rotatably connected to the bracket connecting module, and a rotating shaft exists and is perpendicular to the connecting side.

6. The lamp according to claim 5, wherein:

the splicing structure further comprises an avoidance groove, the avoidance groove is located between the first clamping groove and the third clamping groove, and a notch of the avoidance groove faces in a direction the same as the direction in which the connecting side faces, and the bracket connecting module further comprises a first screw component which penetrates through the bracket, the second bracket connector and the first bracket connector, and the bracket is rotatably connected to the first screw component, and the first screw component has a first screw head which extends into the avoidance groove.

7. The lamp according to claim 4, wherein:

the splicing structure further comprises an avoidance groove, the avoidance groove is located between the first clamping groove and the third clamping groove, and a notch of the avoidance groove faces a direction the same as the direction in which the connecting side faces, and the bracket connecting module further comprises a second screw component, the first bracket connector and the second bracket connector are connected to each other through the second screw component, and the second screw component has a second screw head which extends into the avoidance groove.

8. The lamp according to claim 1, wherein at least one end of the first clamping groove or at least one end of the second clamping groove extends to an edge of the connecting side.

9. The lamp according to claim 1, wherein the lamp further comprises a light exit side, and the connecting side is perpendicular to the light exit side.

10. The lamp according to claim 1, wherein the lamp further comprises a light source module, a mask and a sealing ring, the light source module is arranged on the heat sink, the mask covers the light source module, and the sealing ring is located at a connecting position between the mask and the heat sink.

11. The lamp according to claim 10, wherein the sealing ring is hollow.

12. The lamp according to claim 10, wherein a radial section of one side of the sealing ring attached to the heat sink comprises a wavy shape.

13. The lamp according to claim 1, wherein the lamp further comprises a light source module arranged on the heat sink, the heat sink comprises a light source mounting portion and a plurality of convex ribs protruding from the light source mounting portion, and the plurality of convex ribs and the light source module are respectively on two opposite sides of the light source mounting portion.

14. A lamp assembly, comprising two lamps, and a set of lamp connecting module, wherein each of the two lamps comprises a splicing structure and a connecting side, wherein the splicing structure is arranged on the connecting side, the splicing structure comprises a first clamping groove and a second clamping groove extending in a same direction, and a notch of the first clamping groove and a notch of the second clamping groove face in opposite directions, and wherein the lamp connecting module comprises a first lamp connector and a second lamp connector, each first lamp connector is capable of being clamped with two first clamping grooves of the two lamps at the same time, each second lamp connector is capable of being clamped with two second clamping grooves of the two lamps at the same time, and the first lamp connector is detachably fixed with the second lamp connector, wherein each splicing structure is capable of implementing splicing by clamping the first clamping groove and the second clamping groove with a lamp connecting module, wherein each of the two lamps comprises a heat sink, the connecting side is on the heat sink, and the first clamping groove and the second clamping groove are on the heat sink.

15. The lamp assembly according to claim 14, wherein the lamp assembly further comprises a third screw component which passes through the first lamp connector and the second lamp connector to splice the two lamps.

16. The lamp assembly according to claim 15, wherein the first lamp connector comprises a first fixing portion and two first clamping portions, the two first clamping portions are both connected to the first fixing portion, and the second lamp connector comprises a second fixing portion and two second clamping portions, the two second clamping portions are both connected to the second fixing portion;

each first clamping portion is capable of being clamped with the first clamping groove on one lamp so that the first lamp connector are clamped with two lamps at the same time, and each second clamping portion is capable of being clamped with the second clamping groove on one lamp so that the second lamp connector are clamped with two lamps at the same time; and the first fixing portion and the second fixing portion are provided with corresponding through holes, and the first fixing portion and the second fixing portion are detachably connected by matching the third screw component with the through holes.

17. A lighting lamp, comprising a lighting module, an angle adjusting mechanism and a bracket, wherein the angle adjusting mechanism is slidably arranged in a groove on a side of the lighting module, the bracket is connected to the angle adjusting mechanism, and the angle adjusting mechanism slides to a position to be installed and is fixed on the lighting module, wherein the groove is disposed parallelly along the side of the lighting module, and the angle adjusting mechanism is slidable along the side of the lighting module, and wherein the angle adjusting mechanism comprises a mounting plate, a first toothed base and a second toothed base, wherein the mounting plate is slidably arranged in the groove on the side of the lighting module, the first toothed base is arranged on the mounting plate, the second toothed base is arranged on the first toothed base, a tooth portion of the second toothed base is engaged with a tooth portion of the first toothed base, the bracket is arranged on the second toothed base, and the bracket, the second toothed base, the first toothed base and the mounting plate are fixed by a locking structure.

* * * * *